US007447571B2

(12) United States Patent
Nickles et al.

(10) Patent No.: US 7,447,571 B2
(45) Date of Patent: Nov. 4, 2008

(54) METHOD OF FORECASTING TRAIN SPEED

(75) Inventors: Stephen K. Nickles, Burleson, TX (US); John E. Haley, Burleson, TX (US)

(73) Assignee: New York Air Brake Corporation, Watertown, NY (US)

( * ) Notice: Subject to any disclaimer, the term of this patent is extended or adjusted under 35 U.S.C. 154(b) by 0 days.

(21) Appl. No.: 11/408,973

(22) Filed: Apr. 24, 2006

(65) Prior Publication Data

US 2007/0250225 A1 Oct. 25, 2007

(51) Int. Cl.
*B61L 3/00* (2006.01)

(52) U.S. Cl. ..... 701/20; 246/167 R; 246/122 R; 246/182 R; 342/450

(58) Field of Classification Search ..... 701/20, 701/19; 246/187 R, 167 R, 122 R, 182 R, 246/182 A; 342/450; *G05D 1/00; B61L 3/00; G06F 7/00*
See application file for complete search history.

(56) References Cited

U.S. PATENT DOCUMENTS

| | | | | |
|---|---|---|---|---|
| 3,519,805 | A | 7/1970 | Thorne-Booth | |
| 4,005,838 | A | 2/1977 | Grudy | |
| 4,041,283 | A | 8/1977 | Mosier | |
| 4,042,810 | A | 8/1977 | Mosher | |
| 4,181,943 | A | 1/1980 | Mercer, Sr. et al. | |
| 4,279,395 | A | 7/1981 | Boggie et al. | |
| 4,344,364 | A | 8/1982 | Nickles et al. | |
| 4,384,695 | A * | 5/1983 | Nohmi et al. | 246/182 B |
| 4,401,035 | A | 8/1983 | Spigarelli et al. | |
| 4,561,057 | A | 12/1985 | Haley, Jr. et al. | |
| 4,602,335 | A | 7/1986 | Perlmutter | |
| 4,735,385 | A | 4/1988 | Nickles et al. | |
| 4,794,548 | A | 12/1988 | Lynch et al. | |
| 4,827,438 | A | 5/1989 | Nickles et al. | |
| 4,853,883 | A * | 8/1989 | Nickles et al. | 703/8 |
| 5,109,343 | A | 4/1992 | Budway | |
| 5,744,707 | A | 4/1998 | Kull | |
| 5,758,299 | A | 5/1998 | Sandborg et al. | |
| 5,785,392 | A | 7/1998 | Hart | |
| 5,791,063 | A * | 8/1998 | Kesler et al. | 33/651 |
| 5,828,979 | A * | 10/1998 | Polivka et al. | 701/117 |
| 5,927,822 | A * | 7/1999 | Hart | 303/7 |

(Continued)

FOREIGN PATENT DOCUMENTS

| | | |
|---|---|---|
| EP | 114 633 | 1/1984 |

(Continued)

OTHER PUBLICATIONS

ETCS, System Requirements Specification (SRS) Chapter 2 General Description Version 3.01, No. of pp. 74, (1996).

(Continued)

*Primary Examiner*—Tuan C To
(74) *Attorney, Agent, or Firm*—Barnes & Thornburg LLP

(57) ABSTRACT

A method of speed forecasting a train over a track including determining location of the train on the track, the speed of the train and brake and throttle setting of the train. Speeds and suggested throttle and brake settings for spaced points along the track are calculated based on the determinations. The calculated speeds and throttle and brake setting are displayed for the spaced points along the track.

9 Claims, 2 Drawing Sheets

U.S. PATENT DOCUMENTS

| | | | | |
|---|---|---|---|---|
| 5,950,967 | A | 9/1999 | Montgomery | |
| 6,144,901 | A | 11/2000 | Nickles et al. | |
| 6,263,266 | B1 | 7/2001 | Hawthorne | |
| 6,622,068 | B2 | 9/2003 | Hawthorne | |
| 7,165,748 | B2 * | 1/2007 | Ebuchi et al. | 246/122 R |
| 2003/0105561 | A1 * | 6/2003 | Nickles et al. | 701/19 |
| 2007/0219680 | A1 * | 9/2007 | Kumar et al. | 701/19 |

FOREIGN PATENT DOCUMENTS

| | | | |
|---|---|---|---|
| EP | 467 377 | | 7/1991 |
| EP | 539 885 | | 10/1992 |
| EP | 554 983 | | 1/1993 |
| EP | 615 891 | | 3/1994 |
| JP | 03103008 | A * | 4/1991 |
| WO | WO 90/0362 | | 4/1990 |
| WO | WO 01/20587 | A2 | 3/2001 |

OTHER PUBLICATIONS

Carl Loddecke, Signal Und Draht, Zeitschrift Fur Das Signal- Und Fernmeldewesen Der Eisenbahnen Einschliesshlich Daenverarbeitung, pp. 17-29, (Feb. 1965).

* cited by examiner

METHOD OF FORECASTING TRAIN SPEED

BACKGROUND AND SUMMARY OF THE INVENTION

The present invention relates generally to a locomotive display and more specifically to a method of forecasting and displaying the speed of the train over the route.

In rail systems where scheduling, time to destination, is important by itself or in combination with fuel economy or ride comfort, a projected trip speed profile of the route is calculated and displayed for the train operator. Speed limits and physical limitations of the route are taken into account in preparing the speed profile. Examples of these systems are show in European published applications 467,377 A2 and 539,885 A2 These prior systems are part of train or trip control systems used by the railroads to control the movement and fuel efficiency of the trains in their system.

For long distant hauls or trips over large territories efficient management of the train's speed can be very challenging to the operator. The operator preferably uses independent control of the throttle and brakes. Control of the train's speed is a fundamental operating requirement of the locomotive engineer or operator. For safe operations, he must strictly adhere to posted speed limits, temporary speed restrictions (slow orders), and the speed requirements of approaching signals. He does this by managing the position of the locomotive's throttle and/or dynamic braking handles, and if necessary, the train airbrake handle.

All locomotives are equipped with a speedometer and most have an accelerometer. Unfortunately due to the extreme mass (weight) and length of a typical train, the train is slow at responding to the engineer's control actions. If an engineer makes an airbrake application or release, one to two minutes may pass before the train's brake system is fully applied or released. The train's speed is also significantly affected by the grades over which it is traverses. A display of forecasted speeds at points along the route ahead would allow the train operator or locomotive engineer to anticipate and react ahead of time to train speed ups based on the present brake and throttle settings This system provides for a method of forecasting a train's speed over a track including: determining location of the train on the track, determining the speed of the train and determining the present brake and throttle settings. Recommended brake and throttle settings required to achieve the desired train speed are calculated and displayed for spaced points of the track. Speeds at spaced points along the track are calculated based on the determinations. The calculated speeds are displayed at the spaced points along a display of the track. In essence, the system determines and displays the speed and required brake and throttle settings up ahead based on the locomotive engineer's then current brake and throttle settings. This is an advisory system to allow improved control and decision making by the operator to better achieve the desired train speed. The system is used during long distance train movements over large territories.

Additionally, speeds at the spaced points may be determined and displayed and calculated speeds which exceed the speed limits are determined and displayed. The speeds which exceed the speed limits may be displayed at the spaced points along the display of the track in a manner distinctive from the speeds which do not exceed the speed limits. If one or more calculated speeds exceed the speed limits, suggested brake and throttle settings will be calculated and displayed for the operator, which will permit maintaining the proper train speed. If the operator adheres to and implements the suggested brake and throttle settings, the recommend settings will no longer be displayed. If changes have not been made of brake and throttle settings after display of the suggested setting, the brake and throttle settings may be automatically changed to the suggested brake and throttle settings, if the automatic controls are enabled.

Other objects, advantages and novel features of the present invention will become apparent from the following detailed description of the invention when considered in conjunction with the accompanying drawings.

DETAILED DESCRIPTION OF THE PREFERRED EMBODIMENTS

A LEADER system from New York Air Brake is described in U.S. Pat. No. 6,144,901, which is incorporated herein by reference, and operates on the principle of conservation of energy, kinetic and potential. Math models of the LEADER System, monitors parameters and performs calculations based on the current energy state of the train to create a real-time display of train dynamics. The power of LEADER system resides in its ability to provide information allowing the crew to better control the train, minimizing loss of energy. Loss of energy via over-braking represents fuel unnecessarily consumed. Energy imparted to the cargo of the train represents potential damage to lading, equipment and rail. Both phenomena are undesirable.

Although the LEADER system will be used to implement the present method, other similar systems which can forecast speed over an upcoming rout based on the present state of the train can be used.

Figure 1:
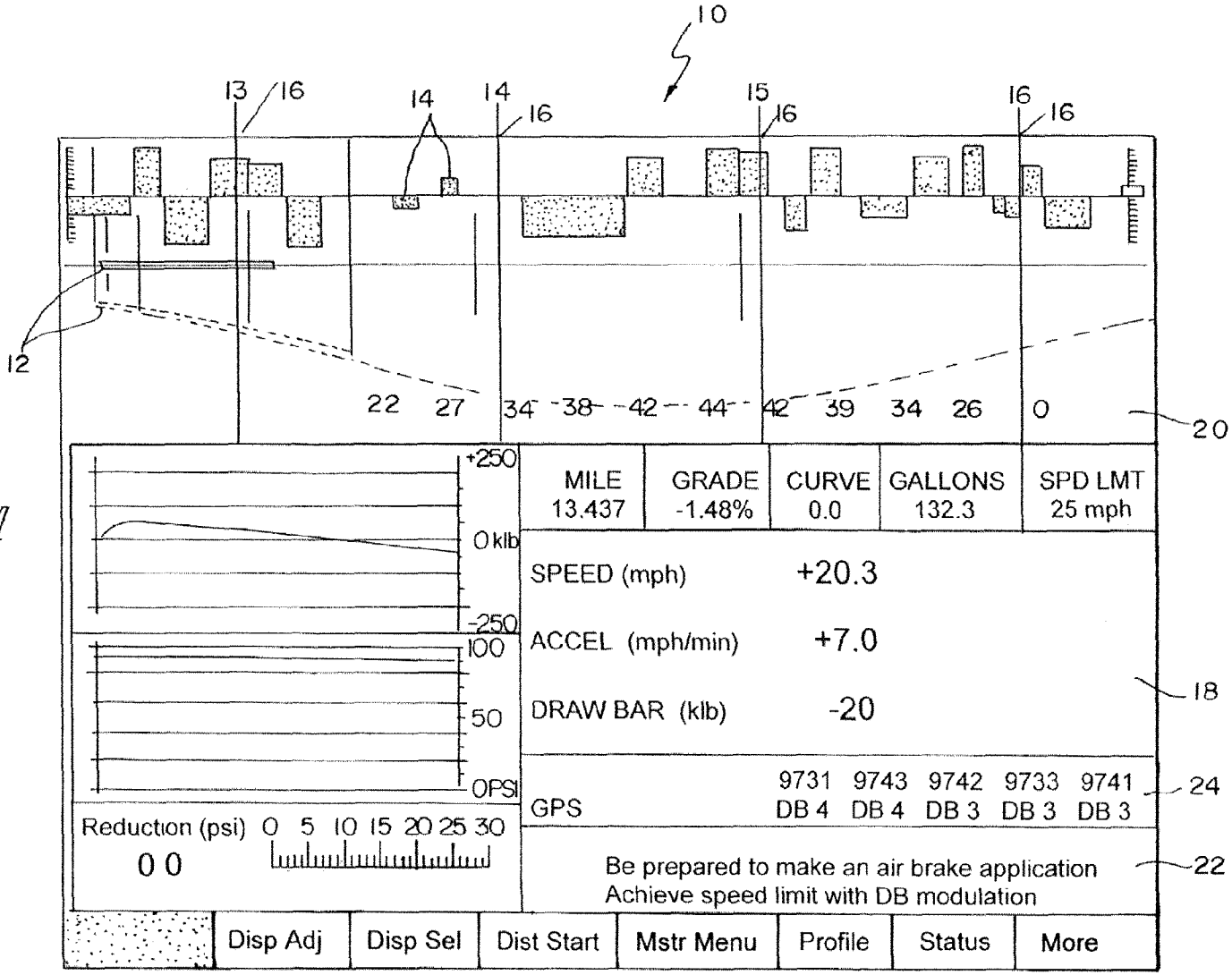
FIG. 1 is a display incorporating the forecasted speed according to the principles of the present disclosure.

FIG. 1 illustrates a display within the cabin of the locomotive. Reference to FIG. 5 of U.S. Pat. No. 6,144,901 provides details of the various elements of the display. Only those of interest to the present disclosure will be described in detail. A train 12 is shown on a track 14. There is a vertical and a horizontal display of the train on the track. Sign posts 16 are illustrated crossing the various track locations. The box 18 displays the present speed, the acceleration and draw bar forces.

As will be described with respect to FIG. 2, the present system determines the present location of the train on the track, train speed and brake of throttle settings and from this forecast the speed of the train at various locations on the route ahead. This is illustrated in FIG. 1 by the boxes 20 with an example of the forecast speed. One of the features of the present system is to recognize speed limits at various points along the track or route and provide an indication of an over speed. Using, for example, a speed limit of 25 mph all but the first and last illustrated speeds would be over that speed limit. These over speeds could be distinctively displayed. For example, the under speed limits speeds may be in yellow whereas the over speed limit forecast speeds could be in red. The over speeds could also be blinking to draw attention to them. The display shows points along the route at quarter mile increments as an example. Other increments may be used.

The present system can also provide other messages to the operator. Messages box 22 provides a message "be prepared to make an air brake application" and "achieves speed limit through the DB modulation." DB is dynamic brake. Box 24 shows a suggested dynamic brake application at a specific GPS location. The DB numbers are representative of a notch of the propulsion handle in the dynamic brake region. As is evident from the track display, the acceleration at the present throttle settings results from the downhill grade of the track. Without adjustment, the speed limits would be exceeded.

Figure 2:
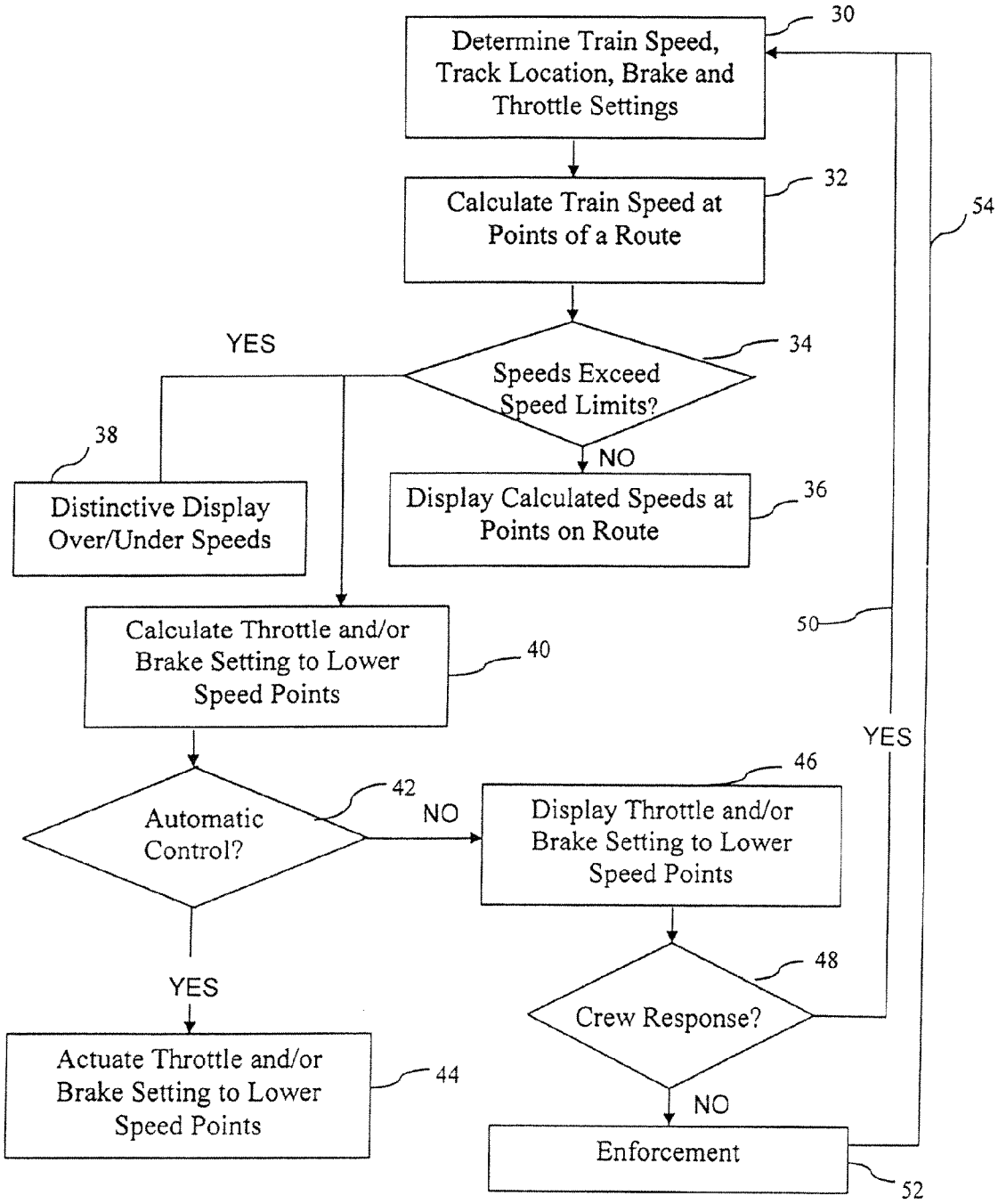
FIG. 2 is a flow chart for speed forecasting according to the present disclosure.

A flowchart of the present method is illustrated in FIG. 2. At step 30, there is a determination of train speed, track location, brake and throttle settings. At step 32, there is a calculation of train speed at points of a route. At step 34, there is a determination of whether any of the speeds at the points in the route exceed the speed limits for that point of the route. If not, there is a display of the calculated speeds at the points on the display of points on the route at step 36. If some of the speeds exceed the speed limit at step 34, then there is a distinctive display of the over and under speeds at step 38.

Also, if there are speeds that exceed the speed limit, there is a calculation of throttle and/or brake settings to lower the speed at points along the route to below the speed limit at step 40. Next, there maybe a determination at step 42 as to whether the train controls is an automatic control. If it is automatic control, then the throttle and/or brake settings are actuated to the settings which lower the speed points at step 44.

If there is not an automatic control at step 42, then the calculated throttle and/or brake settings to lower the speed is displayed at step 46. Next there is a determination of crew response at step 48. If there is a response, then the method is repeated by return route 50 to determining speed, location, and brake and throttle settings and a calculation of the train speeds over the route. If there has been no crew response at step 48, then there can be automatic enforcement at step 52 if selected by the train operator. After the enforcement at step 52, the method is repeated via route 54 to again determine train speed, location, and throttle and brake settings and calculating train speeds and points over the route.

Various displays of the suggested throttle and brake settings shown in FIG. 1 are just one example. Other values or forms of display maybe used. For example, the suggested throttle and brake settings can be displayed with the calculated speed. Also, the suggested throttle and brake settings may be calculated and displayed even if no speed limit is or will be exceeded. As a further variation, if corrective action is not taken, then an alarm indicator maybe activated.

Although the present invention has been described and illustrated in detail, it is to be clearly understood that the same is by way of illustration and example only, and is not to be taken by way of limitation. The scope of the present invention is to be limited only by the terms of the appended claims.

What is claimed:

1. A method of speed forecasting a train over a track, the method comprising:

determining location of the train on the track, the present speed of the train, and brake and throttle setting of the train;

calculating forecasted speeds at spaced points along the track based on the present train speed and location;

calculating suggested brake and throttle settings at spaced points along the track based on the present location, speed and brake and throttle settings and forecasted speeds at the spaced points; and simultaneously displaying the track and forecasted speeds at the spaced points along the track.

2. The method according to claim 1, including determining speed limits at the spaced points and determining and simultaneously displaying forecasted speeds which exceed the speed limits.

3. The method according to claim 1, wherein the brake and throttle settings include pneumatic braking, electropneumatic braking, dynamic braking and propulsion.

4. The method according to claim 1, wherein the suggested brake and throttle settings are simultaneously displayed with the track and forecasted speeds at the spaced points along the track.

5. The method according to claim 4, wherein calculating and displaying the suggested brake and throttle settings at spaced points along the track is performed if one or more forecasted speeds exceed determined speed limits at the spaced points along the track.

6. The method according to claim 4, including determining changes of brake and throttle settings after display of the suggested setting and repeating the method.

7. The method according to claim 4, including determining if changes have been made of brake and throttle settings after display of suggested brake and throttle settings and if not, automatically changing the brake and throttle settings to the suggested brake and throttle settings.

8. A method of speed forecasting a train over a track, the method comprising:

determining location of the train on the track, the present speed of the train, and brake and throttle setting of the train;

calculating forecasted speeds at spaced points along the track based on the present train speed and location;

calculating suggested brake and throttle settings at spaced points along the track based on the present location, speed and brake and throttle settings and forecasted speeds at the spaced points;

simultaneously displaying the track and forecasted speeds, determining speed limits at the spaced points and determining and simultaneously displaying forecasted speeds which exceed the speed limits, wherein the forecasted speeds which exceed the speed limits are displayed at the spaced points along a display of the track in a manner distinctive from the forecasted speeds displayed at the spaced points along the display of the track which do not exceed the speed limits.

9. The method according to claim 8, wherein the forecasted speeds which exceed the speed limits are displayed as one of red and flashing.

* * * * *